United States Patent [19]

Sato et al.

[11] 4,142,899

[45] Mar. 6, 1979

[54] COLOR DIFFUSION TRANSFER PHOTOGRAPHIC UNIT

[75] Inventors: Yuzuru Sato, Hachioji; Masao Asano, Tokyo; Masao Ishihara, Hino; Sadatugu Terada, Hachoiji, all of Japan

[73] Assignee: Konishiroku Photo Industry Co., Ltd., Tokyo, Japan

[21] Appl. No.: 808,909

[22] Filed: Jun. 22, 1977

[30] Foreign Application Priority Data

Jun. 25, 1976 [JP] Japan ..... 51-75200

[51] Int. Cl.[2] ..... G03C 1/40; G03C 5/54

[52] U.S. Cl. ..... 96/77; 96/29 D

[58] Field of Search ..... 9/6, 29 D, 77, 114, 9/84 A; 101/464

[56] References Cited

U.S. PATENT DOCUMENTS

| | | | |
|---|---|---|---|
| 3,709,690 | 1/1973 | Cohen et al. | 96/77 |
| 3,930,864 | 1/1976 | Abel et al. | 96/77 |
| 3,944,424 | 3/1976 | Cohen et al. | 96/77 |

*Primary Examiner*—Richard L. Schilling

*Attorney, Agent, or Firm*—Bierman & Bierman

[57] ABSTRACT

The present invention relates to a color diffusion transfer photographic unit containing a silver halide photosensitive element, and an image receiving element wherein said unit contains a copolymer containing two monomers. The first monomer is noted for having quaternary nitrogen while the second monomer is required to have at least one fluorine atom.

10 Claims, No Drawings

COLOR DIFFUSION TRANSFER PHOTOGRAPHIC UNIT

The present invention relates to a color diffusion transfer unit comprising a photosensitive element and an image-receiving element. Particularly, this invention is concerned with a color diffusion transfer unit using a novel polymer mordant. More particularly, the invention is concerned with a color diffusion transfer unit using a novel polymer mordant of which the mordanting property is excellent without giving any bad effects on the photographic properties; the film forming property is excellent when the mordant is used singly or in combination with a binder; and, no deterioration is found in the image receiving property.

In a color diffusion process, a light sensitive element containing a silver halide emulsion and a dye image forming material is exposed to irradiation to form a latent image in silver halide and then developed with a processing solution (an alkaline processing solution). At the time of the processing, the light sensitive element and an image receiving element having an image receiving layer to which a dye image forming material is mordantable are superposed on each other so that the dye image forming material is transferred by diffusion into the image receiving layer to form a dye image therein.

As the examples of such color diffusion transfer processes, there may be such process as disclosed in U.S. Pat. No. 2,983,606 in which a dye image forming material is a dye developing agent which is a dye capable of developing not only silver halide but also an exposed silver halide emulsion, and such process as disclosed in U.S. Pat. Nos. 2,647,049 and 2,774,668 in which a color developing agent is used to develop a latent image to release a dye image formed material. The image receiving element used in these processes includes those elements in which an image receiving layer containing a water-permeable and alkali liquid-permeable polymer mordant is formed on a transparent or opaque support. As the polymer mordant contained in the image receiving layer are known poly-4-vinylpyridine as disclosed in U.S. Pat. No. 3,148,061, and various vinyl type quaternary salt polymers as disclosed in British Pat. No. 1,261,925.

Desirable as the polymer mordant in the image receiving layer are such that forms dye images on the image receiving layer within a short time when a dye image forming material is moved, by diffusion, into the image receiving element. On the other hand, after an image is formed on the image receiving layer, said image is required substantially never to be changed nor removed. For this purpose, the development of silver halide as well as the production and diffusion of dyes accompanying to the said development is stopped by the reduced alkalinity of the image receiving layer due to the neutralization of a processing solution (an alkaline processing solution) but surplus dyes and dye precursors in addition to the contaminating materials which are formed after obtaining the image are not necessarily fixed. In this case, the surplus of dyes and dye precursors and the contaminating materials diffused slowly into the image receiving layer to cause a gradual change in the image quality after the completion of processing. Therefore, in order to remove such defects, the so-called scavenger layer; that is, a layer containing a scavenging material, is conventionally used in addition to the image receiving layer. As such scavenger layer, it is known to use such as an isocyanate-bissulfite adduct as disclosed in U.S. Pat. No. 3,725,063, a resolsinol scavenger as disclosed in U.S. Pat. No. 3,770,431, and a polymer scavenger as disclosed in U.S. Pat. No. 3,772,014. It is also known to form a scavenger mordant layer independent from the image receiving layer, as disclosed in Japanese Laid-open-to-public Patent Publication No. 142,233/75. Furthermore, it is known that this scavenger layer may be formed in the image receiving element or in another photographic element such as the so-called processing sheet.

We have found that such polymer as set forth below is very effective to mordant the dye image forming material and further that such polymer is effective in case of using said polymer in the scavenger layer or other mordanting layers.

The first object of this invention is to provide a color diffusion transfer unit which shows an excellent mordanting effect.

The second object of this invention is to provide a color diffusion transfer unit using an image receiving layer which may mordant a dye image forming material to produce a good dye image within a short time when said material transfers through diffusion into the image receiving layer at the time of development.

The third object of this invention is to provide a color diffusion transfer unit using a scavenger layer which, after an image is formed in the image receiving layer by processing, may inhibit surplus amount of dyes and dye precursors and the contaminating materials from diffusing into the image receiving element to avoid any adverse effects by them.

The fourth object of the invention is to provide an image receiving element or a processing sheet used in a color diffusion transfer process, in which said element or sheet having a layer shows an excellent mordanting effect without giving any bad effects on the photographic properties.

The fifth object of this invention is to provide a color diffusion transfer process using a layer containing a polymer mordant which has an excellent film forming property in case of using the mordant singly or in combination with a binder.

The sixth object of this invention is to provide a color diffusion transfer process using a polymer mordant which can be used in the image receiving layer of the image receiving element without giving any bad effect on a silver halide emulsion, and further, which may be used, of course, in the scavenger layer of the image receiving element, the processing sheet or the light sensitive element, but also in any mordanting layer of the image receiving element, the processing sheet or the light sensitive element.

These objects and other objects as set forth below are accomplished by using, as the image receiving layer and/or the scavenger layer or as other mordanting layer in the color diffusion transfer process, a layer which contains a polymer mordant containing, as its copolymer components, a monomer having a quarternary nitrogen and a monomer having at least one fluorine atom.

The polymer mordant used in the invention, which contains, as its copolymer components, a monomer having a quarternary nitrogen and a monomer having at least one fluorine atom, will be called hereafter as the polymer mordant of the invention.

A layer containing the polymer mordant of the invention may be used as an image receiving layer of the image receiving element or as a scavenger layer of the image receiving element, the processing sheet or the light sensitive element, or further it may be used as other mordanting layer of the image receiving element, the processing sheet or the light sensitive element. Furthermore, said layer may be served as any single member selected from the group comprising the image receiving layer, the scavenger layer and other mordanting layers or as two or more members thereof. That is, the polymer mordant of this invention may be contained only in an image receiving layer of the receiving element, or contained in the above image receiving layer and a scavenger layer formed in at least one element selected among the image receiving element, the processing sheet and the light sensitive element, or contained only in a scavenger layer formed in at least one element selected among the image receiving element, the processing sheet and the light sensitive element, or further may be contained in other mordanting layers of the image receiving element, the processing sheet or the light sensitive element in addition to each of the above-mentioned three cases.

Because the polymer mordant of this invention has no bad effect on the silver halide emulsion, a layer containing the polymer mordant of this invention may be served for a scavenger layer of the light sensitive element or for any mordanting layer other than a silver halide emulsion layer.

The polymer mordant of this invention may be any compound which contains, as its copolymer components, a monomer having a quarternary nitrogen and a monomer having at least one fluorine atom. The polymer mordant of this invention may be used singly or in combination with one or more other polymer mordants of this invention.

Any combination of the polymer mordant of this invention with other polymer mordants may be used unless such combination has no bad effect on the working or effect of this invention.

The preferable monomer having a quarternary nitrogen as used in this invention may include the compounds of the following general formula [I]:

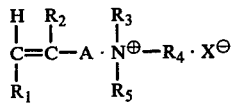

(wherein $R_1$ represents hydrogen or an atomic group necessary to form an N-alkylenemaleimide ring together with A; $R_2$ represents hydrogen or a lower alkyl group; A represents an alkylene group, an allylene group, an aralkylene group, or one of the groups of the following formulae —$COOR_6$—, —$CONHR_6$—, —$OCOR_6$— and —$CONR_6$— (In these formulae, $R_6$ represents an alkylene group); $R_3$, $R_4$ and $R_5$ represent respectively an alkyl group, an allyl group or an aryl group, or $R_4$ and $R_5$ are an atomic group necessary to cooperatively form a heterocyclic ring or to form a heterocyclic ring together with A or a part of A; and, X represents an anion).

In the above-formula, the heterocyclic ring formed by $R_4$ and $R_5$ or $R_4$, $R_5$ and A is preferably pyridine, pyrimidine, imidazoline, imidazole, oxazoline, oxazole or morphorine ring, the anion for "X" is preferably halogen, arylsulfonate, alkyl sulfonate, nitrate, sulfonate and the like.

The typical examples of a monomer containing a quaternary nitrogen as used preferably in the present invention are as follows:

$CH_2{=}CH\,.\,COOCH_2CH_2N^{\oplus}(C_2H_5)_3\,.\,CH_3SO_4^{\ominus}$ (I-1)

(I-2)

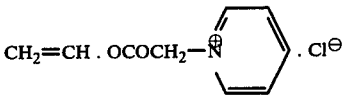

$CH_2{=}C(CH_3)\,.\,COOCH_2CH^{\oplus}(OH)CH_2N(CH_3)_3\,.\,Cl^{\ominus}$ (I-3)

(I-4)

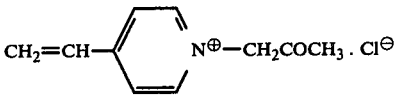

(I-5)

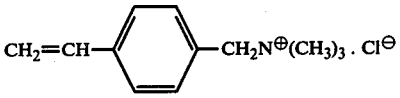

(I-6)

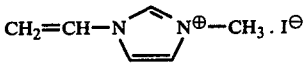

(I-7)

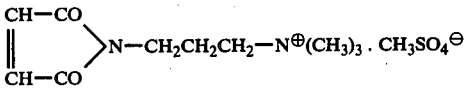

(I-8)

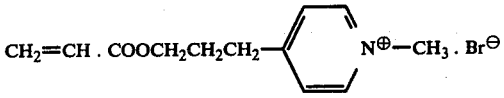

$(CH_2{=}CH{-}CH_2)_2N^{\oplus}\,.\,(CH_3)_2\,.\,Cl^{\ominus}$ (I-9)

$CH_2{=}CHCONHCH_2CH_2N^{\oplus}\,.\,(CH_3)_2(C_2H_5)\,.\,C_2H_5SO_4^{\ominus}$ (I-10)

(I-11)

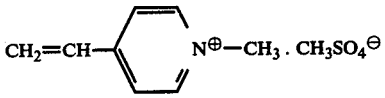

The preferable monomer having at least one fluorine as used in this invention includes the compounds of the following general formula [II]:

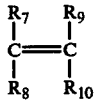

[wherein $R_7$, $R_8$, $R_9$ and $R_{10}$ respectively represent hydrogen fluorine, a lower alkyl group, or one of the groups of the following formulae: —$(CF_2)nF$ ($n$=1 to 8), —$O(CF_2)nF$ ($n$=2 to 8), —$O(CF_2)nH$ ($n$=2 to 8), —$O(CF_2)nOC_6F_5$($n$=2 to 3), —O—$CH_2(CF_2)nH$ ($n$=2 to 8), —$OCH_2(CF_2)nF$ (n=2 to 8) —$COOCH_2$—$(CF_2)nH$ ($n$=2 to 8), —$COO(CH_2)mNR_{11}SO_2(CF_2)nF$ ($m$=2 to 3, $n$=1 to 8; $R_{11}$ represents a $C_{1-4}$ alkyl group), —$COO(CH_2)$ $mNR_{12}CO(CF_2)nF$ ($m$=2 to 3, $n$=1 to 8; $R_{12}$ represents a $C_{1-4}$ alkyl), —$COO(CH_2)mNR_{13}CO(CF_2)nH$ (m=2 to 3, n =1 to 8; $R_{13}$ represents a $C_{1-4}$ alkyl group), —$OCO(CF_2)nH$ (n=1 to 8), -continued $-OCO(CF_2)nF$ (n=1 to 8), $-COOCH_2(CF_2\overset{\overset{CF_3}{|}}{C}F)nH$ (n=1 to 4) and $-OCO(CF_2\underset{\underset{CF_3}{|}}{C}F)nH$ (n=1 to 4);

and $R_7$, $R_8$, $R_9$ and $R_{10}$ may represent either the same group or different groups from one another but at least one member is a group containing a fluorine atom or fluorine atom].

Then, the typical examples of the monomer having at least one fluorine atom as preferably used in this invention include the following:

$CF_2{=}CF_2$ (II-1)

$CH_2{=}CF_2$ (II-2)

$CF_2{=}C(CF_3)F$ (II-3)

$CF_2{=}CFO(CF_2)_nF$ (n=3 - 8) (II-4)

$CF_2{=}CFO(CF_2)_3O{-}C_6F_5$ (II-5)

$CH_2{=}CH\,.\,OCH_2(CF_2)_nF$ (n=2 - 8) (II-6)

$CH_2{=}C(CH_3)\,.\,COOCH_2(CF_2)_nH$ (n=2 - 8) (II-7)

$CH_2{=}CH\,.\,COOCH_2(CF_2)_nH$ (n=2 - 8) (II-8)

$CH_2{=}C(CH_3)\,.\,COOCH_2CH_2CH_2N(C_3H_7)\,.\,SO_2(CF_2)_nF$ (n=1 - 8) (II-9)

$CH_2{=}CH\,.\,COOCH_2CH_2N(C_2H_5)CO(CF_2)_nF$ (II-10)

-continued $CH_2{=}CH\,.\,OCO(CF_2)_nF$ (n=1 - 8) (II-11)

$CH_2{=}CH\,.\,OCO(CF_2)_nH$ (n=1 - 8) (II-12)

$CH_2{=}CH\,.\,COOCH_2(CF_2C(CF_3)F)_nH$ (n=1 - 4) (II-13)

The copolymer used in the present invention, namely a copolymer which contains, as its copolymer components, a monomer containing a quaternary nitrogen and a monomer having at least one fluorine atom, may have other copolymer components. In this case, it is preferably that the combined molar ratio of the monomer containing a quaternary nitrogen and the monomer having at least one fluorine atom is more than 50% based on that of the copolymer and it is more preferable that the monomer containing a quaternary nitrogen is in an amount of 90–40 mol% and the monomer having at least one fluorine atom is in an amount of 60–10 mol% while other copolymerization components is in an amount of 50–0 mol%. However, the type of the copolymerization is not limited in particular. The average molecular weight of the copolymer is preferably 10,000–100,000, especially 15,000–50,000.

The typical monomers mentioned above as the other copolymerization components in the copolymers used in the present invention include, for example, styrene, metastyrene, vinylchloride, vinylidenechloride, isobutylene, ethyl acrylate, methyl methacrylate, acrylamide, N, N-dimethylacrylamide, diacetoneacrylamide, vinylacetate, N-vinylpyrrolidone, diethylaminoethylmethacrylate, 4-vinylpyridine, 2-methyl-N-vinylimidazole and acrylonitrile.

Then, the typical examples of the copolymer used in this invention include the following compounds:

(M.W. means an average molecular weight.)

(1)

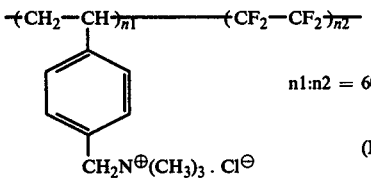

n1:n2 = 60:40

(MW = 45,000)

(2)

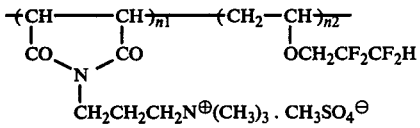

n1:n2 = 45:55

(MW = 28,000)

(3)

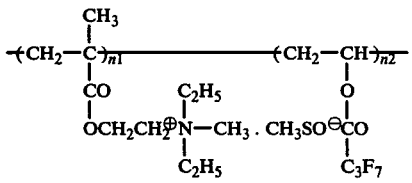

n1:n2 = 80:20

(MW = 37,000)

-continued
(4)
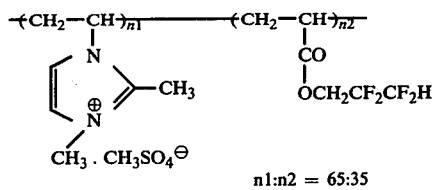
n1:n2 = 65:35
(MW = 33,000)
(5)
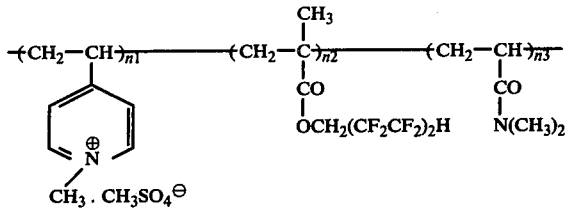
n1:n2:n3 = 70:20:10
(MW = 40,000)
(6)
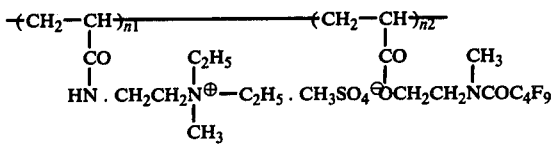
n1:n2 = 65:35
(MW = 25,000)
(7)
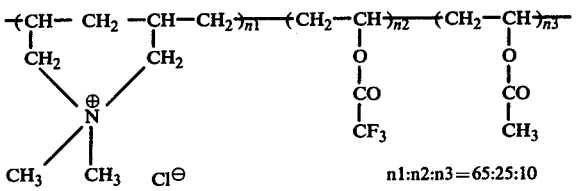
n1:n2:n3=65:25:10
(MW = 21,000)
(8)
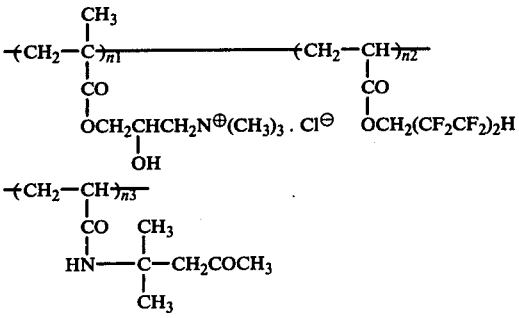
n1:n2:n3=60:30:10
(MW = 39,000)
(9)
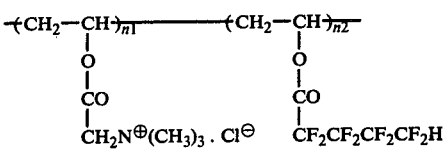
n1:n2=80:20
(MW = 17,000)

-continued
(10)
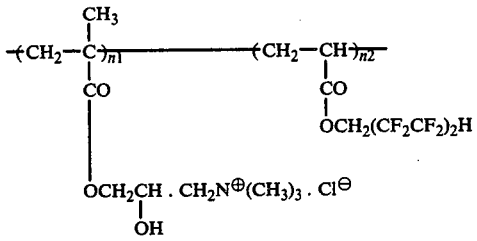
n1:n2=50:50
(MW = 35,000)
(11)
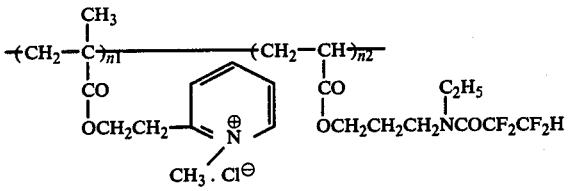
n1:n2=75:25
(MW = 24,000)
(12)
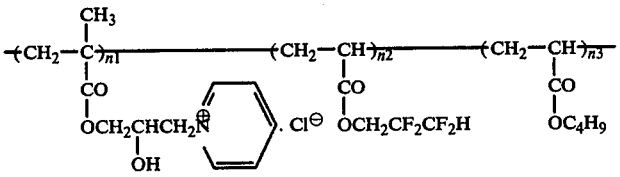
n1:n2:n3=70:25:5
(MW = 36,000)
(13)
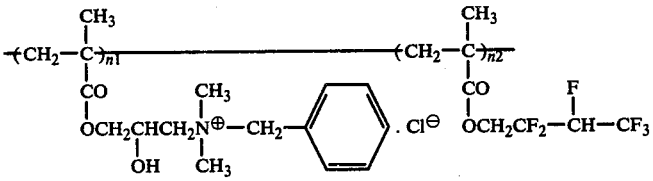
n1:n2=65:35
(MW = 42,000)
(14)
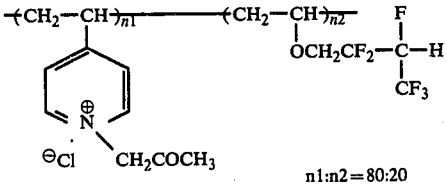
n1:n2=80:20
(MW = 45,000)
(15)
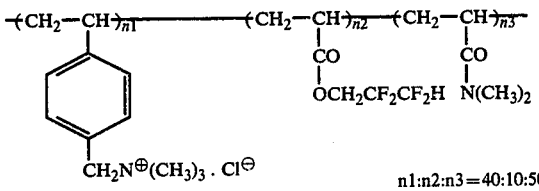
n1:n2:n3=40:10:50
(MW = 27,000)

-continued (16)

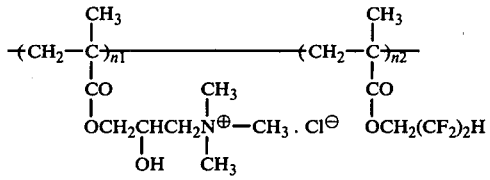

n1:n2=50:50

(MW = 50,000)

(17)

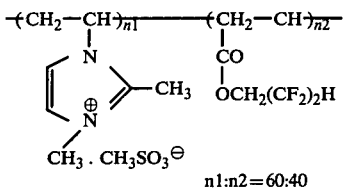

n1:n2=60:40

(MW = 35,000)

As a process for the synthetic preparation of the above-mentioned copolymers used in this invention, there may be employed optionally such various copolymerization reactions or conditions as in a block polymerization process, a solution polymerization process, a suspension polymerization, an emulsion polymerization process or the like process. And, before making a quarternary salt of the monomer of the general formula (I), it may be possible that the monomer of the general formula (II) is copolymerized with a monomer which will turn to be a monomer of the general formula (I) to obtain a copolymer and then the copolymer is subjected to a quaternarization reaction thereby to obtain the copolymer of the invention.

The preferable examples of the synthetic preparation of the copolymer will be illustrated as follows:

(1) Synthetic Preparation of Compound [4]

70g (0.65 mol) of the compound of the following formula:

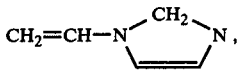

65.1g (0.35 mol) of the compound of the formula $CH_2{=}CHCOOCH_2{-}(CF_2)_2H$ and 0.5g of a,a'-azobisisobutyronitrile were dissolved into 350ml of ethanol and the resulting solution was stirred and heated at 70° C in the nitrogen atmosphere for 10 hours. After allowing to cool, the liquid reaction mixture was poured into 35.5 l of n-hexane to prepare 131g of white solid copolymers. 67.7g of the copolymers as obtained was dissolved into 200ml of methanol and the resulting solution was added with 41.6g (0.33mol) of a dimethylsulfic acid. The resulting solution was reacted at 70° C in a pressure bottle for 20 hours. After the reaction, this solution was poured into 3 l of ether to obtain 101.4g of the objective material as a faintly yellow solid. An aqueous solution containing 1% of the title compound had the specific viscosity of 6.34 at 30° C.

(2) Synthetic Preparation of Compound [10]

23.7g (0.1 mol) of $CH_2{=}C(CH_3).COOCH_2CH(OH).CH_2N(CH_3)3.Cl$ and 28.6g (0.1 mol) of $CH_2{=}CH.COOCH_2\ (CF_2CF_2)_2H$ were dissolved into 250 ml of methanol and the resulting solution was added with 0.5g of a,a'-azoisobutyronitrile. The resulting solution was reacted at 70° C in a pressure bottle for 24 hours. After allowing to cool, the solution was poured into 3 l of ether to be solidified and then dried under a reduced pressure thereby to prepare 47.1g of the intended compound as a white solid. The compound was soluble in methanol and water. An aqueous solution containing 1% of the said material had the specific viscosity of 6.34.

(3) Synthetic Preparation of Compound [14]

20.8g (0.1 mol) of $CH_2{=}CHO{-}CH_2CF_2CH(CF_3)F$ was emulsified to be dispersed into an aqueous solution containing 3g of an anionic active agent, Newlex C-1 (Product by Nihon Yushi Co.) dissolved in 30ml of water. This solution was added with an aqueous solution containing 79.1g (0.4mol) of the compound of the following formula:

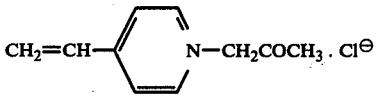

dissolved in 50ml of water. Further, the solution was added with 1g of ammonium persulfate and then stirred and heated at 65° C. in the nitrogen atmosphere for 7 hours. The copolymer emulsion obtained was separated by use of acetone and dissolved again into methanol. The resulted solution was poured into 3 l of ether to prepare white precipitates. The precipitates were dried under a reduced pressure to obtain 93.8g of the objective material. An aqueous solution containing 1% of the objective material had the specific viscosity of 9.45 at 30° C.

The layer containing the polymer mordant of this invention may be used as an image receiving layer and/or a scavenger layer. In case of using the said layer as the image receiving layer of the image receiving element, such layer is available by forming a layer containing the polymer mordant of this invention as an image receiving layer on a support of the image receiving element. While it is desirable, for example, to coat the polymer mordant of this invention or its solution on a neutralizing layer or an inter layer respectively formed on a support, it is also fit to coat the polymer mordant of the invention or its solution directly on the support without forming the said neutralizing or inter layer.

In case of using the polymer mordant of the invention as a solution, it is desirable to use a solution containing, for example, 2–20% of the said mordant. The kind of a solvennt used in this case is not limited but water or a hydrophilic organic solvent such as methanol, ethanol, methyl cellusolve, dioxan or N, N-dimethylformamide can be used singly or in admixture of two or more kinds.

As the above-mentioned support of the image receiving element, there may be used various materials, such as a baryta paper, a paper laminated with a resin like polyethylene, a sheet of such cellulose ester with an organic acid as cellulose diacetate, cellulose triacetate or cellulose acetylbutyrate, a sheet of such cellulose ester with an inorganic acid as cellulose nitrate, a sheet of polyester such as polyethylenetelephthalate, a sheet of polyvinylester such as polyvinylacetate, a sheet of polyvinylacetal type such as polyvinylacetal and a sheet of polyalkylene such as polystyrene, polypropylene or polyethylene, according to the intended purpose.

The neutralizing layer used in this invention includes those which contain such a neutralizing agent as to reduce the pH within the system after the developing process.

The material used as a neutralizing agent is preferably a film forming polymer acid having one or more carboxyl groups, sulfone groups or such group as producing a carboxyl group by hydrolysis. Any kind of the abovementioned polymer acid can be optionally used. The polymer acid used in this invention has the molecular weight of about 10,000 to about 100,000. The said polymer acid includes monobutylester of a copolymer of maleic acid anhydride and ethylene at the ratio of 1:1 and monobutylester of a copolymer of maleic acid anhydride and methylvinylether at the ratio of 1:1 as disclosed in U.S. Pat. No. 3,362,819 and, in addition to these, monoethylester, monopropylester, monopentylester and monohexylester of a maleic acid anhydride-ethylene (1:1) copolymer, monoethylester, monopropylester, monopentylester, and monohexylester of an maleic acid anhydride-methylvinylester (1:1) copolymer, the copolymers of a polyacrylic acid, a polymethacrylic acid or an acrylic acid and a methacrylic acid at various ratios, and the copolymers of an acrylic or methacrylic acid and other vinyl type monomer at various ratios, the copolymers in the latter two cases containing acrylates, methacrylates or vinylethers in an amount of at least 30 mol% and preferably 50–90 mol% of the acrylic acid or methacrylic acid. As other examples of said polymer acid, metal salts, monomer acids, ballasted organic acids, alkylphosphates, polyalkylphosphates, poly-(1-acryloyl-2,2,2-trimethylhydrazinium-p-toluene sulfonate) and the like as disclosed in Research Disclosure No. 12,331 can be used in combination with a binder polymer, if desired. Further, the combination of the polymer acid with a monomer acid or of the polymer acid with an organic amine may be used, if desired. These polymer acids, monomer acids, organic acids or binder polymers can be coated on a support by dissolving them into such as alcohols like methanol, ethanol, propanol and butanol; ketones like acetone, methyl ethylketone, diethyl ketone and cyclohexanone; esters like methyl acetate, ethyl acetate, isopropyl acetate or butyl acetate; and mixtures of these compounds. The thickness of the neutralizing layer thus obtained cannot be definitely decided since it would vary depending on the composition of processing agents used or the kind of materials contained in the neutralizing layer, but it is generally suitable within the range of 5–30 $\mu$.

The above-mentioned neutralizing layer may be formed on any position according to the layer arrangement of the photographic element for diffusion transfer. For example, the neutralizing layer may be formed between an image receiving layer and its support, as disclosed in U.S. Pat. Nos. 3,415,644, 3,473,925, 3,415,646 and 3,415,645; between a light sensitive layer and its support, as disclosed in U.S. Pat. Nos. 3,575,043 and 3,573,042; in a processing sheet or between an image receiving layer and its support, as disclosed in U.S. Pat. Nos. 3,594,164 and 3,594,165; and further between a light sensitive layer and its support and/or between an image receiving layer and its support in the case of such layer arrangement as disclosed in U.S. Pat. No. 3,615,421. Further, the said neutralizing layer may be formed between the image receiving layer and its support in the case of such layer arrangement having a means of stripping off, as disclosed in Japanese Laid-open-to-public Patent Publication No. 3,480/72.

In this invention, an inter layer (a neutralization rate-controlling layer) can be formed in combination with the above-mentioned neutralizing layer in order to control the pH reduction. This inter layer serves to retard the pH reduction until the required development and transfer has been accomplished. Namely, it does to prevent an unfavorable reduction in density of transferred images due to rapid pH reduction caused within the system by the neutralizing layer before silver halide is developed to form a diffusion-transferred image.

This inter layer includes various materials, such as gelatin; polyvinylalcohol, partly acetalized polyvinyl alcohol and partly hydrolyzed polyvinyl acetate as disclosed in U.S. Pat. No. 3,362,819; cyanoethylated polyvinylalcohol as disclosed in U.S. Pat. No. 3,419,389; hydroxypropylmethyl cellulose and isopropyl cellulose as disclosed in U.S. Pat. No. 3,433,633; polyvinylamides as disclosed in Japanese Patent Publication No. 1,267/71; polyvinylamide graft copolymers as disclosed in Japanese Patent Publication No. 41,214/73; and, such combination of a latex solution and a penetrating agent as disclosed in Japanese Laid-open-to-public Publication Nos. 22,935/74 and 91,642/74.

On the other hand, in case of using as a scavenger layer, a layer containing the polymer mordant of this invention may be formed as such scavenger layer in any of the photographic elements comprising the image receiving element, the processing sheet and the light sensitive element. For example, in such layer arrangement as disclosed in U.S. Pat. Nos. 3,415,644, 3,473,925, 3,573,043, 3,573,042 and 3,615,421, the polymer mordant of the invention or its solution may be coated between a light sensitive layer (the silver halide emulsion layer) and its support, or between the light sensitive layer and the image receiving layer. Further, the polymer mordant of the invention or its solution can be contained in the above-mentioned inter layer or the neutralizing layer to be served also for a scavenger layer. Furthermore, in the case of such layer arrangement as disclosed in U.S. Pat. Nos. 3,415,645, 3,415,646, 3,594,164 and 3,594,165, the layer containing the polymer mordant of the invention may be used as a scavenger layer in the processing sheet.

The polymer mordant of the invention may harden by itself or in combination with other binder to form a mordanting film. The suitable binder includes, without any limitation, water soluble polymers such as gelatin, polyvinylalcohol, carboxymethyl cellulose, hydroxyethyl cellulose, starch, polyacrylamide and polyvinylpyrrolidone. In case of using these polymers in combination with the polymer mordant of the invention, the ratio of combination may be selected optionally. But, in case of containing the polymer mordant of the invention in the image receiving layer, the desirable content of the polymer mordant of the invention in the image receiving layer is within the range of 10–100% by weight and in case of containing the polymer mordant of the invention in the scavenger layer or other mordanting layers, it is desirable to use the polymer mordant of the invention at the same content as shown in the above case.

The thickness of a layer containing the polymer mordant of the invention can be varied according to the various purposes, and for example, if the said layer is an image receiving layer, in the optimum thickness is between 3μ and 10μ, and if the layer is a scavenger layer, the desirable thickness is between 0.5μ and 10μ.

In the present invention, a processing sheet can be used according to the layer arrangement of the photographic element. The processing sheet can be either useful as a light barrier or/and effective to uniformly distribute a processing agent therein. The former can be a light barrier sheet as such and the latter may be a transparent or opaque sheet capable to have a processing solution distribute and diffuse uniformly. In case of forming a scavenger layer in the processing sheet, a layer containing the polymer mordant of the invention may be formed on a support of the processing sheet, and in case of forming a neutralizing layer and/or an inter layer, the polymer mordant of the invention may be contained in the above-mentioned layer to serve as a scavenger layer. As the support of the processing sheet, such materials as used for the above-mentioned support of the image receiving element may be optionally used according to the purpose. For the processing sheet for a light barrier, pigments such as carbon black or titanium oxide may be contained in the support or coated on the support, if desired, by using a binder.

The above-mentioned image receiving element is used to obtain a color image by placing same in face-to-face contact with the imagewise exposed light sensitive element for color diffusion transfer, spreading a processing agent (an alkaline processing solution) between these two thereby to effect development of the silver halide emulsion and then transferring the resulting dye image-forming material to the image receiving element.

The light sensitive element for color diffusion transfer comprises at least one silver halide emulsion layer formed on a support, and a dye image forming material combined with silver halide in the silver halide emulsion layer. Particularly, it is desirable that said light sensitive element has a red light sensitive emulsion layer, a green light sensitive emulsion layer and a blue light sensitive emulsion layer formed successively on a support and that said element has a cyan dye image forming material, a magenta dye image forming material and a yellow dye image forming material in combination with the emulsions respectively contained in the above-mentioned emulsion layers. In the light sensitive element, if desired, a yellow filter layer, an antihalation layer, an inter layer, a protective layer or the like layer may be formed. The above-mentioned support is preferably such plane material as does not show any significant dimensional change at the time of processing with a processing compositon. While a hard support like glass may be used depending on the purpose, a plastic support is generally useful. Preferable as the plastic support are those used for an ordinary photographic material, which include as its advantageous examples a cellulose nitrate film, a cellulose acetate film, a polyvinylacetal film, a polystyrene film, a polyethyleneterephthalate film and a polycarbonate film. Further, it is advantageous in the invention to use such vapor-permeable support as disclosed in U.S. Pat. Nos. 3,573,044 and 3,690,879, in order to dissipate water of a processing solution (an alkaline processing solution) through the support after processing. Moreover, it is preferable that a transparent support is colored to such an extent as not to disturb the imagewise exposure and visual observation but as to prevent the pipeing of light entered from the sides. The support may contain various photographic additives as desired, such as a plasticizer like phosphates or phthalates, an ultraviolet absorbing agent like 2-12-hydroxy-4-t-butylphenyl, benzotriazole and an anti-oxidant like hindered phenol. In order to keep the adhesion of a layer containing a hydrophilic polymer to the support, it is advantageous to form a sub layer or apply a pre-treatment such as a corona discharge, an ultraviolet irradiation and a flaming over the surface of the support. The thickness of the support is not limited but is desired usually to be between 20μ to 30μ. In case of using a support for a light barrier, carbon black, titanium oxide or the like pigments may be contained in the support or coated in combination with a binder on the support.

A process for preparing a dye image as used in the color diffusion transfer process of the invention may be carried out in various manners according to the method wherein a dye image forming material releases a diffusible dye by the development of silver halide. The dye image forming material may contain beforehand a consummated dye moiety or form a dye moiety at the time of the development or its succeeding steps starting with the development and further the dye may be formed in the image receiving layer after the essential components for formation of such dye have moved into said layer.

Among methods for dye formation by the diffusion transfer, three typical ones are described. The first typical method is the so-called dye developer method. In this method, a dye developer is employed which a compound having both a dye forming group and a silver halide developing group in one molecule, wherein the dye developer as a dye image forming material is oxidized with silver halide, and as the result, the reduction of silver halide and the oxidation of the dye developer occur, so that diffusibility changes in the processing composition. The oxidized dye developer has lower solubility and diffusibility in the processing agent compared with the dye developer in the reduced form and it is fixed near around reduced silver halide. The dye developer is substantially insoluble in an aqueous acidic or neutral medium, but it has preferably at least one residue dissocitable enough to make the dye developer soluble and diffusible at the alkalinity of the processing agent. Such dye developer may be incorporated into the light sensitive element, and particularly into the silver halide emulsion layer or its adjacent layer, and it may be used in the light sensitive element having the combination of the silver halide emulsion and the dye developer having the absorption spectrum according to the sensitive wavelength region of said silver halide emulsion. When the diffusion transfer is carried out from the light sensitive element having at least one light sensitive unit of the aforementioned combination to the image receiving element, one time of development may be sufficient to yield a monocolor or multicolor positive transfer image. In the color diffusion transfer process according to this first typical method, more particularly, the development of a latent silver halide image in the light sensitive element is carried out in the presence of the dye developer, so that the dye developer in the exposed portion is oxidized and substantially fixed. At least one part of this fixation is considered to depend at least partly on the change in the solubility of the dye developer at the time of oxidation, particularly in the alkaline solution. In the unexposed and partly exposed portions of the emulsion, the dye developer may be unreacted and diffusible, so that the imagewise distribution of the unoxidized dye developer may be provided as the function of the degree of exposure of the silver halide emulsion at each point. At least one part of this imagewise distributed unoxidized dye developer is transferred to the image receiving layer superposed on said emulsion layer. This transfer excludes substantially the oxidized dye developer. The image receiving element provides the image reversed from the developed image by accepting the imagewise diffused unoxidized dye developer from the developed emulsion, without any distortion of the imagewise distribution of the unoxidized dye developer.

This first method for the color diffusion transfer process is disclosed in many patents such as British Patent 804,971. In the present invention, the particularly useful dye developer is the one having a benzenoid group as a silver halide developing group. The preferable benzenoid group in this compound is a hydroquinoyl group. The typical examples in U.S. Pat. Nos. 2,983,606, 3,345,163, 3,255,001, 3,218,164, 3,453,107, 3,551,406, 3,135,605, 3,421,892, 3,563,739, 3,482,972, 3,415,644, and 3,594,165. Further, as the dye developer used in the invention may be a hydrolyzable dye developer having a hydrolyzable group therein and a shorter wave length shift type dye developer. The typical examples of the dye developers includes such compounds as disclosed in U.S. Pat. Nos. 3,230,082, 3,329,670, 3,307,947, 3,230,083, 3,230,084, 3,230,085, 3,579,334, 3,295,973, 3,196,014 and 3,336,287, Japanese Patent Publication Nos. 379/61, 12,393/61, and 2,241/62, and U.S. Pat. Nos. 3,312,682 and 3,826,801. Furthermore, in the invention, there may be effectively used a leuco dye developer comprising a colorless leuco-body provisionally transformed by reducing the dye moiety thereof. The typical examples of such leuco dye developers may include such compounds as disclosed in U.S. Pat. Nos. 2,909,430, 3,320,063, 2,892,710 and 2,992,105, and Japanese Laid-open-to-public Publication Nos. 66,440/73 and 66,441/73.

The second typical method comprises of reacting a product oxidized with silver halide with a dye image forming material to release a diffusible dye. Particularly, this method is classified into types A, B and C. The A type method is to use a reactive nondiffusible material capable of coupling with an oxidized developer, so that the coupling reaction of both may result in release of a soluble and diffusible dye into a processing solution. A diffusible dye-releasing coupler of this type contains the coupling reactive part which is substituted with a residue splittable upon the reaction with the oxidized developer. The electron conjugation of the dye to be released may be present beforehand in the coupler or may be formed by the coupling reaction. The coupler of the former case has a spectral absorption close to that of the dye to be released. On the other hand, the coupler of the latter case is in principle colorless, and even when it is colored, the absorption of the coupler has no direct relation to that of the dye released. As the compounds used for the above-mentioned A type method, there may be such as disclosed in U.S. Pat. Nos. 3,227,550, 3,880,658 and 3,765,886, British Patents 840,731, 904,364, 904,365 and 1,038,331, and Japanese Laid-open-to-public Patent Publication No. 15,471/70. The above-mentioned B type method is based on the intramolecular ring closing reaction, subsequent to the condensation with an oxidized developer, of a dye image forming material with a substituent at the position adjacent to the reacted position of the preceding reaction, thereby to cleave a dye residue from said substituent. More particularly, this method comprises oxidative coupling of a dye image forming material with an aromatic primary amino developer with a phenol or aniline at its 4-position, followed by the azine ring formation with a 3-positioned sulfonamido group containing a dye moiety, thereby to release a diffusible dye having a sulfinic group. The compounds used for the B type method are disclosed in e.g. U.S. Pat. Nos. 3,443,940 and 3,734,726. The above-mentioned C type method comprises ring closure of a dye image forming material by oxidation of with an oxidized auxiliary agent as the development product or decomposition of the said material with an alkali to release a diffusible dye. Dye image formation of this type may be carried out by using an auxiliary agent such as hydroquinones and 3-pyrazolidones. The typical examples of the dye image forming material are disclosed in U.S. Pat. Nos. 3,725,062, 3,698,897, 3,728,113, 3,443,939, 3,443,940, 3,245,789 and 3,880,658, Belgian Pat. No. 796,041 and 796,042, and Japanese Laid-open-to-public Patent Publication Nos. 33,826/73 and 114,424/74.

The third typical method comprises using a dye image forming material which undergoes ring opening reaction with alkali to release a diffusible dye but cannot react substantially in the presence of an oxidized developer. The typical examples of the dye image forming material is disclosed in such as Japanese Laid-open-to-public Patent Publication No. 111,682/74. The above-mentioned first and third methods provide a positive diffusion transfer dye image if using a negative silver halide emulsion layer on development. In contrast to this, the second method gives a negative diffusion transfer image if using a negative silver halide emulsion on development. For obtaining a positive image, therefore, the second method need to comprise the reversion method. For example, there may be used direct positive emulsions such as internal latent image type emulsions as disclosed in U.S. Pat. Nos. 2,592,550, 2,588,898 and 3,227,552, and fogged emulsions as disclosed in British Pat. Nos. 443,245 and 462,730 and U.S. Pat. Nos. 2,005,837, 2,541,472 and 3,367,778. Further, this purpose may implemented by processing with a developer solution containing a solvent for silver halide solvent a layer containing a diffusible dye releasing coupler and a physically developed nucleus, the said layer formed at the position adjacent to a negative silver halide emulsion layer. The examples of this case are disclosed in U.S. Pat. No. 3,639,731. Furthermore, the above purpose may be implemented by forming a negative silver halide emulsion layer which contains a development inhibitor-releasable compound when reacted with the oxidation product of a developer such as 1-phenyl-5-mercaptotetrazole and adjacent thereto a layer which contains a diffusible dye-releasing coupler and a self-reducible metal salt. The examples of this case are disclosed in U.S. Pat. Nos. 3,148,062, 3,227,551, 3,227,554, 3,364,022 and 3,701,783, and Japanese Patent Publication Nos. 21,778/68 and 49,611/72. In this invention, these combinations between the emulsions with the dye image forming materials may be used and the methods for forming the negative or positive dye images may be optionally selected.

The dye image forming material used in this invention may be dispersed into a silver halide emulsion layer in the light sensitive element or into its adjacent layer (supporting the former) of a hydrophilic colloid, such as gelatin or polyvinylalcohol, in any desired manner depending on the type of the dye image forming material. The dye image forming material having such a split-off group as a sulfo or carboxyl group may be dissolved into water or an aqueous solution and then added to a hydrophilic protective colloid solution. A dye image forming material hardly soluble in an aqueous medium but easily soluble in an organic solvent is dissolved into the organic solvent and the resulting solution is added into a hydrophilic protective colloid solution, and then the above-mentioned material may be dispersed as fine particles by stirring the said solution. As said organic solvent, a high boiling solvent, a low boiling solvent such as removable from the dispersion by evaporation, or the combination of an easily water-soluble in water organic solvent with the said high boiling solvent may be used respectively. For example, a process as disclosed in Japanese Patent Publication No. 13,837/68 may be effectively used for dispersing the dye image forming material used in this invention. As a particularly useful high boiling solvent in this invention there may be included N-n-butylacetanilide, diethyl laurylamide, dibutyllaurylamide, dibutylphthalate, tricresyl phosphate, triglyceride of higher fatty acid and dioctyladipate. Further, for stabilizing the dispersion of the dye image forming material, a sulfite may be presented as disclosed in U.S. Pat. No. 3,287,133. The dye image forming material used in this invention may be dispersed directly as fine particles into the hydrophilic protective colloid without use of the high boiling solvent or the like, as disclosed in Japanese Patent Publication No. 32,131/73 and U.S. Pat. No. 3,832,173. The amount of the dye image forming material used in this invention is selected within a wide range, depending on the kind of the specific compound used and the result desired, but it is preferable to use, for example, about 0.5 to about 10 wt.% in the hydrophilic protective colloind coating solution to be coated.

It is advantageous to use an inter layer in the light sensitive element in case of carrying out the multicolor photographic process in this invention. The inter layer inhibits an unfavorable mutual action occurring between the emulsion layers different in their color sensitivity and also controls the diffusibility of the dye image forming material or an alkaline processing composition. As this inter layer, gelatin, calcium alginate, or any member belonging to the group as disclosed in U.S. Pat. No. 3,384,483, a vinyl acetate-crotonic acid copolymer, isopropyl cellulose and hydroxypropylmethyl cellulose as disclosed in Japanese Patent Publication No. 47,606/72, polyvinylamide graft copolymer as disclosed in U.S. Pat. No. 3,575,700 and a system of a latex solution and a permeating agent. This inter layer may contain such interaction inhibitor as selected corresponding to the types of the dye image forming material and the processing agent. For example, in the dye image forming material which releases a diffusible dye by the reaction with the oxidation of the developer, a reducing agent such as a nondiffusible hydroquinone derivative or a non-diffusible coupler which may be fixed by reacting with the oxidation product is effective enough to inhibit an undesirale exchange between the oxidation products of the developers in each emulsion layer units.

The silver halide emulsion used in this invention may comprise colloidal dispersoids of silver chloride, silver bromide, silver chlorobromide, silver iodobromide, silver chloroiodobromide and the mixture of these or the like. This silver halide emulsion may contain silver halide as fine grains or as coarse grains and those having the average particle diameter within the range of about $0.1\mu$ to about $2\mu$ are useful. Further, this silver halide emulsion may be modified in any conventionally known process and may include e.g. a single jet emulsion such as the Lippmann's emulsion and a thiocyanate or thioetheraged emulsion such disclosed in U.S. Pat. Nos. 2,222,264, 3,320,069 and 3,271,157. Furthermore, the emulsion containing silver halide particles having substantial light-sensitivity on their surface and the emulsion containing silver halide particles having substantial light-sensitivity within them may be used. These silver halide emulsions are disclosed, for example, in U.S. Pat. Nos. 2,592,250, 3,206,313 and 3,447,927. In this invention, moreover, the negative emulsion may be used and the direct positive emulsion disclosed in U.S. Pat. Nos. 2,184,013, 2,541,472 and 3,367,778, British Pat. No. 723,019, French Pat. No. 1,520,821 and U.S. Pat. Nos. 2,563,785, 2,456,953 and 2,861,885.

The silver halide emulsion used in this invention may be sensitized with a natural or chemical sensitizing agent contained in gelatin, such as a sulfur, a selenium or tellurium compound, a gold, platinium or palladium compound or any combination of these. The suitable processes for sensitization are disclosed, for example, in U.S. Pat. Nos. 1,623,499, 2,399,083, 3,297,477 and 3,297,446.

For the silver halide emulsion used in this invention, there may be used a speed increasing compound such as polyalkyleneglycol, a cationic surface active agent, a thioether or any combination of these as disclosed in U.S. Pat. Nos. 2,886,437, 3,046,132, 2,944,900 and 3,294,540. The silver halide emulsion used in this invention may be protected from the fog formation and may be stabilized against reduction in sensitivity under preservation. The suitable fog inhibitors or stabilizers which may be used singly or in combination are thiazolium salts as disclosed in U.S. Pat. Nos. 2,131,038 and 2,694,716 azaindenes as disclosed in U.S. Pat. Nos. 2,886,437 and 2,446,605, mercury salts as disclosed in U.S. Pat. Nos. 2,728,663, thiazoles as disclosed in U.S. Pat. No. 3,287,135, sulfocatechol as disclosed in U.S. Pat. No. 3,236,652, nitrogen, oximes and nitroindazoles as disclosed in British Pat. No. 623,448, mercaptotetrazoles as disclosed in U.S. Pat. No. 2,403,927, mercaptoazoles as disclosed in U.S. Pat. Nos. 3,266,897 and 3,397,987, multivalent metal salts as disclosed in U.S. Pat. 2,839,405, thiuronium salts disclosed in U.S. Pat. No. 3,220,839, and palladium, platinum and gold salts as disclosed in U.S. Pat. Nos. 2,566,263 and 2,597,915.

It is preferable that the silver halide emulsion layer, the layer containing a dye image forming material, the layer containing a mordant and the processing liquid-permeable layer such as the protective layer or the inter layer, respectively, contain as a binder a hydrophilic polymer such as, for example, gelatin, gelatin modified with an acrylating agent or the like, gelatin grafted with vinyl polymer, protein like casein, albumin, cellulose derivative like hydroxyethylcellulose, hydroxypropylcellulose, carboxymethylcellulose and methylcellulose, partial hydrolyzate of polyvinyl alcohol and vinyl acetate, polyvinylpyrrolidone, polyacrylamide, polyvinylethers, high molecular non-electrolyte like polymethylvinylether, a polyacrylic acid, partial hydrolyzate of polyacrylamide and an anionic synthetic polymer like copolymerizate of vinylmethylether and a maleic acid. These hydrophilic polymers may be used singly or in admixture. The hydrophilic polymer layer may contain a latex-like polymer dispersion of a hydrophobic monomer like alkylacrylate and the like. In this invention, the hydrophilic polymer, particularly, a polymer having a functional group such as an amino group, a hydroxyl group or a carboxyl group may be made insoluble with various hardening agents without losing the permeability of the processing agent. As the particularly useful hardening agent, there may be included e.g. aldehydes such as formardehyde, glyoxal and glutaraldehyde; N-methylol compounds such as N-hydroxymethylphthalimide and 1-hydroxymethylbenzotriazole; ketones such as 2.5-hexadione, 1,2-cyclopentadione; methylol compounds such as N-polymethylol- and hexamethylolmelamine; epoxy compounds such as 1.4-bis(2.3-epoxypropoxy) diethylether; azilidine compounds such as triethylenephosphoamide; and high molecular compounds such as 3-hydroxy-5-chloro-8-triazinyl gelatin. Further, the hydrophilic polymer layer may contain, in addition to a hardener, a hardening accelerator such as carbonates and resorcine.

In order to impart an additional light sensitivity to the silver halide emulsion used in this invention, there may be used an optically sensitizing dye. For example, the silver halide emulsion may be treated with the organic solvent of the sensitizing dye or added with said dye in the form of dispersion as disclosed in British Patent 1,154,781, thereby to accomplish the additional sensitivity. To obtain an optimum result, it is preferable to add said dye to the emulsion at the final step or at its preceeding step. The useful sensitizing dyes for sensitization of the said silver halide emulsion are disclosed in e.g. U.S. Pat. Nos. 2,526,632, 2,503,776, 2,493,748 and 3,384,486. The optical sensitizer effectively usable in this invention may include cyanines, merocyanines, styrils, hemicyanines (e.g. enaminehemicyanine), oxonols and hemioxonols. The cyanine type dye should preferably contain a basic nucleus e.g. a thiazoline, oxazoline, pyrroline, pyridine, oxazole, thiazole, selenazole or imidazole ring. Said nucleus may contain an alkyl group, an alkylene group, a hydroxyalkyl group, a sulfoalkyl group, a carboxyalkyl group, an aminoalkyl group and an enamine group and it may be fused to a carbocyclic ring or a heterocyclic ring. The said rings may be either substituted with a halogen group, a phenyl group, an alkyl group, a haloalkyl group, a cyano group or an alkoxy group or unsubstituted. The above-mentioned dye may have symmetrically or asymmetrically an alkyl group, a phenyl group, an eminane group or a heterocyclic group, as a substituent on the methylene or polymethylene chain of said dye. The merocyanine dye contains the basic nucleus as mentioned above and such acidic nucleus as e.g. thiohydantoin, rhodanin, oxazolidenedione, thiazolidenedione, barbituric acid, thiazolineone and malononitrile. These acidic nucleus may be substituted with an alkyl group, an alkylene group, a phenyl group, a carboxyalkyl group, a sulfoalkyl group, a hydroxyalkyl group, an alkoxyalkyl group, an alkyamino group or a heterocyclic nucleus. If desired, any combination of the above-mentioned dyes may be used. In this invention, furthermore, there may be contained, if desired, such as a supersensitizing additive not absorbing visible rays like ascorbic acid derivatives, azaindenes, cadmium salts or organic sulfonic acids as disclosed in e.g. U.S. Pat. Nos. 2,933,390 and 2,937,089.

As the processing agent (the alkaline processing solution), any liquid composition containing a processing component necessary to develop the silver halide emulsion and form the diffusion transfer image may be used. As a solvent for this processing agent, water or a hydrophilic solvent such as e.g. methanol or methyl cellosolve may be optionally used. It is preferable that the processing agent preserves the pH necessary to cause the development of the emulsion layer and contains an alkali agent in the amount sufficient enough to neutralize acids formed at the respective steps of the development and image formation. As the alkali agent, sodium hydroxide, calium hydroxide, calcium hydroxide, tetramethylammonium hydroxide, sodium carbonate, disodium phosphete, diethylamine or the like may be used. It is preferable that the processing agent has a pH more than about 12 at a room temperature. The processing agent used in this invention may contain a high molecular thickner inert to an alkaline solution, such as e.g. hydroxyethylcellulose or sodium carboxymethylcellulose. The concentration of the thickner is preferably about 1 – 5 wt% based on the amount of the processing agent and in this case the viscosity of about 100 – 200,000 centipoises may be imparted to the processing agent so that the processing agent may be easily spread uniformly at the time of processing and also that the unification of the photographic element after the processing may be helped by the formation of a non-flowable film when the processing agent is concentrated due to the transfer of the aqueous medium into the light sensitive element and the image receiving element at the time of processing. This polymer film may also be used to serve for the prevention of change in the image by inhibiting the further transfer of the image forming component into the image receiving layer after the formation of the diffusion transfer image is substantially complete. It is advantageous in some cases that the processing agent contains a light-absorbing material like carbon black to inhibit the silver halide emulsion from fogging due to the external light. Further, the processing agent contains a processing component proper to the used image forming material. For example, in the case of the dye developing agent, it is preferable to contain an auxiliary developing agent such as p-aminopheol, 4'-methylphenylhydroquinone or 1-phenyl-3-pyrazolidone, an onium type development accelerator such as N-benzyl-α-picolinium bromide and a fogging inhibitor such as benzotriazole. And, in the case of the diffusible dye releasing coupler, it is preferable to contain an oxidation inhibitor such as an aromatic primary amino color developing agent and a silver halide solvent such as sodium thiosulfate or sodium thiocyanate.

In the color diffusion transfer process according to this invention, the development may be carried out in the presence of an onium compound. The onium compound includes quarternary ammonium compounds, quarternary phosphate compounds and quarternary sulfonium compounds. The onium compound effectively used in this invention may include, for example, 1-benzyl-2-picolinium bromide, 1-(3-bromopropyl)-2-picolinium-p-toluenesulfonic acid, 1-phenethyl-2-picolinium bromide, 2,4-dimethyl-1-phenethylpyridinium bromide, α-picolino-β-naphthoylmethyl bromide, N,N-diethylpiperidinium bromide, phenethyltrimethylphosphonium bromide and dodecyldimethylsulfonium-p-toluenesulfonium. While the onium compound may be used anywhere in the photographic element and the image receiving element, it is preferable to be contained in the processing agent (the alkaline processing solution). The practical examples and use of the onium compound are disclosed, for example, in U.S. Pat. Nos. 3,411,904 and 3,173,786.

A light reflecting material may be used in this invention in order to form a white background for the image prepared in the image receiving layer. The suitable light reflecting material includes titanium oxide, barium sulfate zinc oxide, alumina, barium stearate, calcium carbonate, silicate, zirconium oxide, kaolin, magnesium oxide and the like and they may be used singly or in combination. These light reflecting materials may be either formed beforehand, or formed at certain place from the precursors present in the photographic element as disclosed in Belgian Pat. Nos. 768,110 and 768,111. Further, the light reflecting material may be contained in a hydrophilic polymer such as polyvinylalcohol, gelatin, hydroxypropylcellulose and polyvinylpyrrolidone, or in a layer having as a binder a vinylpolymer containing an anionic solubilizing group as disclosed in U.S. Pat. No. 3,721,555. Furthermore, the light reflecting material may be fixed in the dispersed form in the film-forming polymer, such as hydroxyethylcellulose or carboxymethylcellulose, which is contained in the processing agent and then spread while processing. In combination with the light reflecting agent may be used a fluorescent whitening agent such as stilbene, coumarine, triazine or oxazole. In this invention, moreover, the indicator dye as disclosed in Belgian Pat. Nos. 743,336, 768,107 and 768,109 may be used in combination with the light reflecting material in order to protect the silver halide emulsion layer from the surrounding light at the time of processing.

It is preferable that the processing agent (the alkaline processing solution) used in this invention is stored in a rupturable container. For example, a hollow container may be prepared by folding a non-liquid- and non-air-permeable sheet and sealing each end thereof. It is desirable that the certain place of the container holding the processing agent therein is destroyed by the inner pressure of the agent when the photographic element passes through the pressing means thereby to release the agent. As the material forming the said container, such material as a polyethylene terephthalate/polyvinylalcohol/polyethylene laminate or a lead foil/vinyl chrolide-vinyl acetate copolymer laminate may be used advantageously. It is also desirable that the container is fixed along with the front edge of the photographic element to develop the stored liquid substantially in one direction over the surface of the photographic element. The preferable examples of such the container are disclosed in e.g. U.S. Pat. Nos. 2,543,181, 2,643,886, 2,653,732, 2,723,051, 3,056,491, 3,056,492, 3,152,515 and 3,173,580.

It is preferable that the photographic element used in this invention has a hydrophilic colloid as its surface layer. As the hydrophilic colloid, it is desirable to use, for example, gelatin, starch, dextrin, polyvinylpyrrolidone, gum arabic, carboxymethylcellulose, hydroxyethylcellulose, polyvinylalcohol, guar gum and gum acasia.

In this invention, a peeling-off agent may be used when the photographic element and the image receiving element are peeled off from each other to obtain an image. The peeling-off agent may be used on the surface of the silver halide emulsion layer or the image receiving layer containing the mordant or in the processing agent. As the suitable peeling-off agent, those of such composition as different from that of the binder used in the silver halide emulsion. The examples of the suitable peeling-off agent may include alkali-permeable polysaccharide, carboxymethylcellulose, hydroxyethylcellulose, hydroxypropylcellulose, 4,4'-dihydroxyphenol glucose, cane sugar, sorbitol, inositol, resorcinol, sodium phitate, zinc oxide, fine grain polyethylene, fine grain poly-(4-ethylene fluoride), polyvinylpyrrolidone/polyvinyl hydrogen phthalate as disclosed in U.S. Pat. No. 3,325,283 and styrene-maleic anhydride copolymer as disclosed in U.S. Pat. No. 3,376,137. Further, the hydrophilic colloid surface layer on the image receiving element may contain an ultraviolet absorbing material, for example, such compounds as disclosed in e.g. U.S. Pat. Nos. 3,460,942, 3,069,262 3,330,680 and 3,330,656. Furthermore, if desired, there may be contained a fluorescent whitening agent such as e.g. stilbene, coumarine, triazine or oxazole.

In the photographic layer constituting the photographic element, the image receiving element, the processing sheet or the like as used in this invention, if desired, there may be contained surface active agents like saponin, the anionic compounds like alkylarylsulfonate as disclosed in U.S. Pat. No. 2,600,831, the amphoteric compounds like such as disclosed in U.S. Pat. No. 3,133,816 and the water-soluble glysidol-alkylphenol adducts as disclosed in British Pat. No. 1,022,878.

Further, there may be contained various thickness and a variety of the above-mentioned surface active agents into the coating composition to make easy the coating of the photographic layer used in this invention. For example, the anionic polymers showing a thickening action by the interaction with a binder polymer in the coating composition, like, for example, a high molecular weight acrylamide or acrylic acid type polymer may be also used effectively for this invention.

The photographic layer used in this invention may be formed in the various processes like, for example, dip coating, air-knife coating, curtain coating or the extrusion coating using a hopper as disclosed in U.S. Pat. No. 2,681,294. If desired, two or more layers may be formed simultaneously in such mariner as disclosed in U.S. Pat. No. 2,761,791 and British Pat. No. 837,095. This invention may also be used for such vacuum-deposited silver halide layer as disclosed in British Pat. No. 968,453 and U.S. Pat. No. 3,219,451.

The photographic element layer used in this invention may be hardened with various organic or inorganic hardeners, singly or in combination. As the suitable hardner, there may be included, for example, aldehydes, flocked aldehyes, ketones, carboxylic acid derivatives, carbonic acid derivatives, sulfonates, sulfonylhalides, vinylsulfonylethers, active halogen compounds, epoxy compounds, azilidines, active olefins, isocyanates, carbodiimides, mixed function hardners and polymer hardners, for example, oxidized polysacchalide like dialdehydo starch and oxyguar gum.

The sensitizing dye and other additives used in this invention may be added as in aqueous solution. Said dye and other additives may be added in various methods as disclosed in U.S. Pat. Nos. 2,912,343, 3,342,605, 2,996,287 and 3,425,835.

The photographic element layer used in this invention may contain, for example, light absorbing materials and filter dyes as disclosed in U.S. Pat. Nos. 3,253,921, 2,274,782, 2,527,583 and 2,956,879. If desired, these compounds may be mordanted as disclosed in U.S. Pat. Nos. 3,282,699.

This invention is illustrated more specifically in reference to the following examples but it is not intended to limit the practical modes of this invention thereto.

EXAMPLE I

A photographic element was prepared by successively forming the following layers on an acetylcellulose film support which had been subbed with gelatin.

(1) Cyan dye developer layer:

1,4-bis(α-methyl-β-hydroquinonylethyl amino)-5,8-dihydroxyanthraquinone was dissolved into the mixed solvent of N-n-butylacetanilide and 4-methylcyclohexanone. The resulting solution was dispersed into an aqueous gelatin solution containing a dispersing agent, Alkanol B (E.I. Du Pont & Nemours Co.). Then, the coating was carried out so that the amount of gelatin was 4.2 g/m$^2$ and that of the cyan dye developer was 2.0 g/m$^2$.

(2) Red light sensitive emulsion layer:

The red light sensitive silver iodo bromide emulsion was coated so that the amount of silver was 0.6 g/m$^2$ and that of gelatin was 24 g/m$^2$.

(3) Inter layer:

Gelatin was coated for its amount to be 2.0 g/m$^2$.

(4) Magenta dye developer layer:

2-[p-β-hydroquinonylethyl)phenylazo]-4-n-propoxy-1-naphthol was dissolved into the mixed solvent of N-n-butylacetanilide and 4-methylcyclohexanone. The resulting solution was dispersed into an aqueous gelatin solution containing the dispersing agent, Alkanol B. Then, the coating was carried out so that the amount of gelatin was 2.8 g/m$^2$ and that of the magenta dye developing agent was 1.3 g/m$^2$.

(5) Green light sensitive emulsion layer:

The green light sensitive iodo-bromide emulsion was coated so that the amount of silver was 1.2 g/m$^2$ and that of gelatin was 1.2 g/m$^2$.

(6) Inter layer:

Gelatin was coated for its amount to be 1.5 g/m$^2$.

(7) Yellow dye developer layer:

1-phenyl-3-N-n-hexylcarboxyamide-4-[(p-2',5'-dihydroxyphenethyl)phenylazo]-5-pyrazolone was dissolved into the mixed solvent of N,N-diethyllaurylamide and ethyl acetate. The resulting solution was dispersed into an aqueous solution containing a dispersing agent, Alkanol B. Then, the coating was carried out so that the amount of gelatin was 1.1 g/m$^2$ and that of the yellow dye developing agent was 0.5 g/m$^2$.

(8) Blue light sensitive emulsion layer:

The blue light sensitive iodo bromide was coated so that the amount of silver was 0.6 g/m$^2$ and that of gelatin was 0.6 g/m$^2$.

(9) Protective layer:

4'-methylphenylhydroquinone was dissolved into N,N-diethyllaurylamide. The resulting solution was dispersed into an aqueous gelation solution. Then, after 100 ml of the coating solution thus prepared was added with 5 ml of an aqueous 2% mucochrolic acid solution, the coating was carried out so that the amount of 4'-methylphenylhydroquinone was 0.5 g/m$^2$ and that of gelatin was 0.6 g/m$^2$.

The processing agent (an alkaline processing solution was prepared in the following composition:

| | | |
|---|---|---|
| Water | 100 | ml |
| Calcium hydroxide | 11.2 | g |
| Carboxymethylcellulose | 5 | g |
| Benzotriazole | 7.0 | g |
| N-phenethyl-α-picolinium bromide | 2.0 | g |
| Benzylaminopurine | 0.12 | g |
| Titanium dioxide | 50 | g |

A processing pod containing the above-mentioned processing agent was placed between the above-mentioned photographic element and the image receiving element comprising an image receiving layer containing one of various polymer mordants (the control compounds and the above-exemplified compounds) as shown in Table I which wil be presented below. After imagewise exposure, the photographic element was passed through the pressing roller to carry out the development. Then, the maximum density (D max) of cyan (C), magenta (M) and yellow (Y) of the photographic element was measured ten minutes after the processing by using red, green and blue filters. The result thus obtained was shown in Table I.

The image receiving element was prepared by forming an image receiving layer having a dry thickness of 5μ in such procedures as follows: adding 0.1 g of polyoxyethylenenonylphenylether into 100 g of an aqueous solution containing 3 wt.% of the polymer mordants of this invention as shown in Table I and 6 wt.% of polyvinylalcohol (Gosenol NH-26 available from Japan Synthetic Chemical Industry Co.) and then coating the resulting solution on a transparent polyethylenetelephthalate film base having the thickness of 100μ.

As a control, instead of the polymer mordant used in the above-mentioned image receiving element was used the polymer mordant [A] of the following formula:

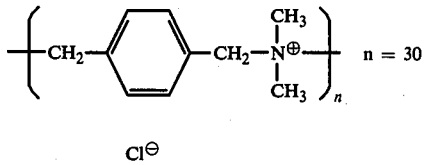

Table I

| Image Receiving Element No. | Exemplified Compound | Y | M | C |
|---|---|---|---|---|
| 1 | [A] | 1.02 | 1.25 | 1.21 |
| 2 | [1] | 1.21 | 1.55 | 1.82 |
| 3 | [2] | 1.45 | 1.65 | 1.81 |
| 4 | [6] | 1.33 | 1.48 | 1.48 |
| 5 | [7] | 1.40 | 1.50 | 1.49 |
| 6 | [9] | 1.62 | 1.83 | 1.56 |
| 7 | [12] | 1.71 | 1.93 | 1.63 |
| 8 | [14] | 1.52 | 1.79 | 1.40 |
| 9 | [15] | 1.63 | 1.77 | 1.56 |
| 10 | [16] | 1.46 | 1.68 | 1.60 |
| 11 | [17] | 1.70 | 1.95 | 1.66 |

It is obvious from Table I that the unit of the present invention (Image Receiving Element Nos. 2–11) using, as an image receiving layer, a layer containing the polymer mordant of this invention provides an excellent maximum density.

EXAMPLE 2

A photographic element was prepared by succesively forming the following layers on an acetylcellulose film support which had been subbed with gelatin.

(1) Green light sensitive silver bromide, gelatin and 1-phenyl-3-(3,5-disulfobenzoamide)-4-(6-hydroxy-4-pentadecylphenylazo)-5-pyrazolone potassium neutral salt were coated so that the respective amounts were 1.0 g/m$^2$, 2.6 g/m$^2$ and 0.8 g/m$^2$.

(2) Gelatin was coated for its amounts to be 2.0 g/m$^2$.

On the image receiving layer, 20.0 g/m$^2$ of titanium dioxide and 2.0 g/m$^2$ of gelatin was coated to form a light reflecting layer. Then, on this layer, 0.6 g/m$^2$ of gelatin was coated as a protective layer to prepare an image receiving element.

Then, a processing agent of the following composition was prepared and stored in a processing pod:

| | |
|---|---|
| 4-Amino-N-ethyl-N-β-hydroxyethyl-aniline hydrochloride | 3 g |
| Hydroxyethylcellulose | 3.2 g |
| Piperidinohexoseledactone | 0.08 g |
| Sodium hydroxide | 3 g |

The above-mentioned pod was placed between the above-mentioned light sensitive element and image receiving element. After imagewise exposure, the photographic element thus obtained was passed through pressing rollers to carry out the development. Then, the maximum density of the dye image ten minutes after the processing was measured to give results in Table 2.

Table 2

| Image Receiving Element used in Example I | Dmax |
|---|---|
| 1 | 1.22 |
| 4 | 1.60 |
| 5 | 1.72 |
| 7 | 1.98 |
| 8 | 1.90 |

It is obvious from Table 2 that the unit of this invention (Image Receiving Element Nos. 4, 5, 7 and 8) provides the excellent maximum density also in case of forming a light reflecting layer.

EXAMPLE 3

A photographic element for diffusion transfer was prepared by successively forming the following layers on a transparent acetylcellulose film support.

(1) Image receiving layer:

A image receiving layer having a dry thickness of 5μ was formed by adding 0.1 g of polyoxyethylenenonylphenylether into 100g of an aqueous solution containing 3 wt.% of the polymer mordant (the above-exemplified compound) as shown in Table -3 and 6 wt.% of polyvinylalcohol (Gosenol NH-26 by Japan Synthetic Chemical Industry Co.) and coating the resulting solution.

(2) Light reflecting layer:

20.0 g/m$^2$ of titanium dioxide and 2.0 g/m$^2$ of gelatin were coated to form the layer.

(3) Opaque layer:

2.0 g/m$^2$ of gelatin and 2.0 g/m$^2$ of carbon black were coated to form the layer.

(4) Layer containing yellow dye image forming material:

1.0 g/m$^2$ of the compound having the following formula:

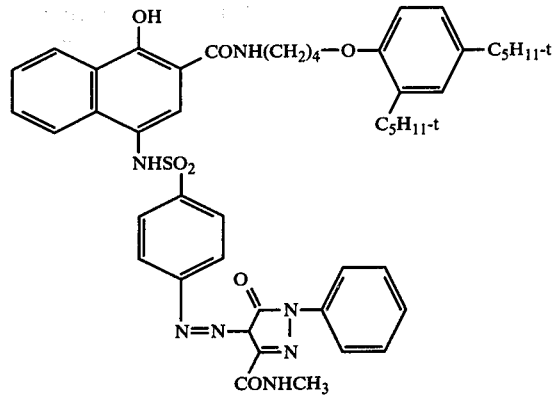

and 1.0 g/m$^2$ of gelatin were coated to form the layer.

(5) Blue light sensitive emulsion layer:

0.6 g/m$^2$ (silver equivalent amount) of blue light sensitive iodo bromide and 0.6 g/m$^2$ of gelatin was coated to form the layer.

(6) Protective layer:

0.5 g/m$^2$ of gelatin was coated to form the layer.

The processing sheet used here was a polyethylenetelephthalate film.

The composition of the processing agent as prepared was as follows:

| | | |
|---|---|---|
| Hydroxyethylcellulose | 2.5 | g |
| Sodium hydroxide | 6.0 | g |
| 4-Hydroxymethyl-4-methyl-1-phenyl-3-pyrazolidone | 0.8 | g |
| Potassium iodide | 0.001 | g |
| 5-Methylbenzotriazole | 0.08 | g |
| t-Butylhydroquinone | 0.08 | g |
| Sodium sulfate | 0.2 | g |
| Carbon black | 4.0 | g |
| Water | 100 | ml |

A processing pod storing the above-mentioned processing agent was placed between the above-mentioned photographic construction element and the processing sheet. The photographic element thus obtained was imagewise exposed and then passed through pressing rollers to carry out the development. The maximum density of the resulted color image 10 minutes after the procession was measured through a blue filter. The results as obtained was shown in Table 3.

As a control, the above-mentioned polymer mordant [A] was used instead of the polymer mordants used in the above-mentioned photographic element.

Table 3

| Photographic Element No. | Polymer Mordant | Dmax |
|---|---|---|
| 12 | [A] | 1.10 |
| 13 | [6] | 1.45 |
| 14 | [7] | 1.52 |
| 15 | [12 ] | 1.56 |
| 16 | [14 ] | 1.51 |

It is obvious from Table 3 that the unit of this invention (Photographic element Nos. 13, 14, 15 and 16) provides an excellent maximum density.

EXAMPLE 4

Photographic elements were prepared in the same manner as in Example 3, except that a different kind of processing sheet was used. The processing sheet was prepared by successively forming on a polyethylenetelephthalate film support the following layers:

(1) Scavenger layer:

20.0 g/m$^2$ of the polymer mixture comprising of four parts of a polyacrylic acid and one part of a polymer mordant was coated to form the layer.

(2) Inter layer (timing layer):

3.0 g/m$^2$ of the polymer mixture comprising 95 parts of cellulose acetate, 5 parts of a styrene-maleic anhydride copolymer was coated to form the layer.

The minimum density of the color images obtained one day after the processing were shown as in Table 4.

Table 4

| Photographic Element No. | Polymer Mordant (Image Receiving Layer & Scavenger Layer) | D min |
|---|---|---|
| 12 | [A] | 0.33 |
| 13 | [6] | 0.15 |
| 14 | [7] | 0.16 |
| 15 | [12] | 0.17 |
| 16 | [14] | 0.14 |
| 17 | [1] | 0.16 |
| 18 | [17] | 0.17 |

*In photographic Element Nos. 12–16, the photographic element used in Example 3 and the processing sheet of this example having a scavenger layer were used in combination, while element Nos. 17 and 18 comprised the polymer mordants as shown in Table 4 to prepare the photographic element in the same manner as in Example 3 and they were using said photographic element combined with the processing sheet having the scavenger of this example.

It is obvious from Table 54 that an increase in Dmin is inhibited according to the unit of this invention (Photographic Element Nos. 13–18).

EXAMPLE 5

The same procedures as in Example 4 were carried out, except that the image receiving layer having a dry thickness of 5$\mu$ contained, as the image receiving layer materials, a polymer mordant, poly-4-vinylpyridine and gelatin at the weight ratio of 1:2.

The result measured one day after the development was shown in Table 5.

Table 5

| Photographic Element No. | Exemplified Compound (Scavenger Layer) | D min |
|---|---|---|
| 12 | [A] | 0.30 |
| 13 | [6] | 0.16 |
| 14 | [7] | 0.18 |
| 15 | [12] | 0.14 |
| 16 | [14] | 0.15 |
| 17 | [1] | 0.19 |
| 18 | [17] | 0.16 |

It is obvious from Table 5 that an increase in Dmin is inhibited according to the unit of this invention (Photographic Element Nos. 13–18).

EXAMPLE 6

The same procedures as in Example 3 were carried out, except that 10 wt.% of the polymer mordant was contained on the basis of the contents of gelatin in the light reflecting layer. Dmax and Dmin were measured 10 minutes after the processing to give results in Table 6.

Table 6

| Photographic Element No. | Exemplified Compound | Dmax | Dmin |
|---|---|---|---|
| 12 | [A] | 1.11 | 0.30 |
| 13 | [6] | 1.43 | 0.14 |
| 14 | [7] | 1.53 | 0.13 |
| 15 | [12] | 1.59 | 0.16 |
| 16 | [12] | 1.53 | 0.15 |

It is obvious from Table 6 that Dmax is high and an increase in Dmin is inhibited according to the unit of this invention (Photographic Element Nos. 13–18).

EXAMPLE 7

The same procedures as in Example 6 were carried out, except that the image receiving layer having the dry thickness of 5$\mu$ contained as the image receiving layer materials a polymer mordant, poly-4-vinylpyridine and gelatin at the weight ratio of 1:2.

Dmin was measured ten minutes after the processing to give the result in Table 7.

Table 7

| Photographic Element No. | Polymer Mordant | Dmin |
|---|---|---|
| 12 | [A] | 0.33 |
| 13 | [6] | 0.13 |
| 14 | [7] | 0.12 |
| 15 | [12] | 0.14 |
| 16 | [14] | 0.14 |
| *19 | [6] + [14] | 0.13 |

*Photographic Element No. 19 was the example wherein two kinds of the polymer mordants of this invention were used in combination at the weight ratio of 1:1.

It is obvious from Table 7 that an increase in Dmin is inhibited according to the unit of this invention (Photographic Element Nos. 13–19).

What we claim is:

1. A color diffusion transfer photographic unit comprising a silver halide photosensitive element having a light-sensitive silver halide emulsion layer, an image-receiving element having a dye-image receiving layer, and a support, said unit comprising a copolymer containing as comonomers a first monomer having quaternary nitrogen and represented by the following formula

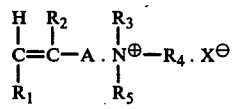

[I]

wherein $R_1$ represents hydrogen or an atomic group necessary to form an N-alkylenemaleimide ring together with A, $R_2$ represents hydrogen or lower alkyl, A represents alkylene, allylene, aralkylene, or a member selected from the group —$COOR_6$—, —$CONHR_6$—, —$OCOR_6$— and —$CONR_6$— wherein $R_6$ represents alkylene;

$R_3$, $R_4$ and $R_5$ represent respectively, alkyl, allyl, or aryl, or $R_4$ and $R_5$ are an atomic group necessary to form a heterocyclic ring or to form a heterocyclic ring together with A, and X represents an anion, and a second monomer having at least one fluorine atom and represented by the following formula

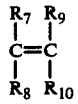

[II]

wherein $R_7$, $R_8$, $R_9$ and $R_{10}$ respectively represent hydrogen, fluorine, lower alkyl, or a member selected from the group consisting of $-(CF_2)_nF$ ($n=1$ to 8), $-O(CF_2)_nF$ (n=2 to 8), $-O(CF_2)_nH$ (n=2 to 8), $-O(CF_2)_nOC_6F_5$ (n=2 to 3), $-C-CH_2(CF_2)_nH$(n=2 to 8), $-OCH_2(CF_2)_nF$ (n=2 to 8) $-COOCH_2(CF_2)_nH$ ($n=2$ to 8), $-COO(CH_2)_mNR_{11}SO_2(CF_2)_nF$ (m=2 to 3, $n=1$ to 8; $R_{11}$ represents a $C_{1-14}$ alkyl group), $-COO(CH_2)_mNR_{12}CO(CF_2)_nF$ ($m=2$ to 3, $n=1$ to 8; $R_{12}$ represents a $C_{1-4}$ alkyl), $-COO(CH_2)_mNR_{13}CO(CF_2)_nH$ ($m=2$ to 3, $n=1$ to 8; $R_{13}$ represents a $C_{1-4}$ alkyl group), $-OCO(CF_2)_nH$ (n=1 to 8), $-OCO(CF_2)_nF$ ($n=1$ to 8), $-COOCH_2(CF_2\overset{CF_3}{\overset{|}{C}}F)_nH$ (n=1 to 4) and $-OCO(CF_2\underset{CF_3}{\underset{|}{C}}F)_nH$ (n=1 to 4);

and $R_7$, $R_8$, $R_9$ and $R_{10}$ may be the same or different with the proviso that at least one of $R_7$ – $R_{10}$ must contain at least one fluorine atom.

2. A color diffusion transfer photographic unit according to claim 1 wherein a combined amount of the monomers in the copolymer is not less than 50 mole %.

3. A color diffusion transfer photographic unit according to claim 2 wherein said copolymer is present in said image-receiving element.

4. The color diffusion transfer photographic unit according to claim 1 wherein said image-receiving element comprises an image-receiving layer containing said copolymer.

5. The color diffusion transfer photographic unit according to claim 4 wherein the image-receiving layer has a dry thickness of 3–10$\mu$.

6. The color diffusion transfer photographic unit according to claim 5 wherein the amount of the copolymer in the image-receiving layer is 10–100% by weight.

7. The color diffusion transfer photographic unit according to claim 4 wherein the unit further comprises a processing sheet having thereupon a photosensitive element having thereon the image receiving element.

8. The color diffusion transfer photographic unit according to claim 1 wherein the unit further comprises a processing sheet containing said copolymer having thereupon the photosensitive element having thereon the image receiving element.

9. The color diffusion transfer photographic unit according to claim 8 wherein the processing sheet comprises a scavenger layer containing the copolymer.

10. The color diffusion transfer photographic unit according to claim 1 wherein an amount of the first monomer is 40–90 mole % of the copolymer while an amount of the second monomer is 10–60 mole % of the copolymer.

* * * * *